United States Patent [19]

Focke et al.

[11] Patent Number: 5,050,855

[45] Date of Patent: Sep. 24, 1991

[54] APPARATUS FOR EXTRACTING (PACK) BLANKS FROM A BLANK MAGAZINE

[75] Inventors: Heinz Focke; Kurt Liedtke, both of Verden, Fed. Rep. of Germany

[73] Assignee: Focke & Co. (GmbH & Co.), Verden, Fed. Rep. of Germany

[21] Appl. No.: 473,028

[22] Filed: Jan. 31, 1990

[30] Foreign Application Priority Data

Feb. 21, 1989 [DE] Fed. Rep. of Germany ..... 3905214

[51] Int. Cl.[5] ..... B65H 5/10

[52] U.S. Cl. ..... 271/132; 271/11; 271/100; 271/101

[58] Field of Search ..... 271/11, 12, 99–101, 271/131, 132

[56] References Cited

U.S. PATENT DOCUMENTS

| | | | |
|---|---|---|---|
| 3,055,658 | 9/1962 | Kister | 271/101 |
| 3,218,061 | 11/1965 | Rabinow | 271/11 |
| 3,394,930 | 7/1968 | Guggisberg | 271/101 |
| 4,369,962 | 1/1983 | Spiro | 271/100 |
| 4,637,600 | 1/1987 | Bartimes et al. | 271/101 |

FOREIGN PATENT DOCUMENTS

| | | | |
|---|---|---|---|
| 141789 | 5/1985 | European Pat. Off. . | |
| 1060701 | 7/1959 | Fed. Rep. of Germany . | |
| 2219540 | 10/1973 | Fed. Rep. of Germany . | |
| 2244533 | 4/1974 | Fed. Rep. of Germany . | |
| 7415169 | 6/1976 | Fed. Rep. of Germany . | |
| 2638767 | 3/1977 | Fed. Rep. of Germany . | |
| 3220237 | 12/1983 | Fed. Rep. of Germany . | |
| 3328322 | 2/1985 | Fed. Rep. of Germany . | |
| 3421164 | 5/1985 | Fed. Rep. of Germany . | |
| 3738102 | 5/1989 | Fed. Rep. of Germany . | |
| 1218004 | 1/1971 | United Kingdom . | |
| 1296579 | 11/1972 | United Kingdom . | |
| 1525698 | 9/1978 | United Kingdom | 271/100 |
| 2023105 | 12/1979 | United Kingdom . | |
| 2133779 | 8/1984 | United Kingdom . | |

*Primary Examiner*—Robert P. Olszewski
*Assistant Examiner*—Steve Reiss
*Attorney, Agent, or Firm*—Sughrue, Mion, Zinn, Macpeak & Seas

[57] ABSTRACT

A process and an apparatus for the extraction of pack blanks (10) from a blank magazine (25). A special problem with high-performance packing machines is the extraction of blanks from the blank magazine (25) of the packing machine, especially thin cardboard blanks which are produced outside the packing machine. The "transfer rollers" so far mainly used herefore take a lot of time and are ponderous due to their complex motions. In order to extract respective lowermost blanks (10) from a blank magazine (25), there is provided an extractor in the form of a blank segment (39) which grasps a blank at one side and leads the blank (10) with slight deformation, namely in an acute angle, to the plane of a conveyor track (38). Because of the very sparse movements of the blank (10) during extraction, the extraction process can be performed within short strokes.

13 Claims, 7 Drawing Sheets

APPARATUS FOR EXTRACTING (PACK) BLANKS FROM A BLANK MAGAZINE

BACKGROUND OF THE INVENTION

The invention relates to a process for extracting (pack) blanks made of (thin) cardboard from a blank magazine, especially for producing hinge-lid boxes for holding cigarettes, in which blank stacks in the blank magazine are held in the region of a (lower) extraction opening solely by two supporting means (supporting fingers) situated on two opposite sides of said extraction opening, said supporting means resting against the free (bottom) side of the blank which is to be extracted. The invention furthermore relates to an apparatus for extracting and transporting away the (pack) blanks.

The invention is concerned with the handling of prefabricated, specifically pre-punched blanks within a packing machine. For making packs of thin cardboard, especially hinge-lid boxes for cigarettes, the blanks are normally produced outside the packing machine and are supplied to said machine in the form of a blank stack. The packing machine is provided with a blank magazine being arranged upright or slightly tilted and from which the blanks are successively extracted via an extraction opening. The individual blanks a are then conveyed to a folding aggregate (folding turret) for further machining.

Hitherto, several so-called transfer rollers are generally used for extracting the individual blanks from the blank magazine. These consist of a roller or drum, which holds the blank to be extracted along its periphery and which is moved about its own axis and is moved to and fro (translationally) underneath the extraction opening, approximately parallel to the plane of said opening. The blank is transferred from the periphery of the transfer roller to a conveyor. This extraction process at the same time causes the blanks to be turned over, so that in the blank magazine, the bottom side of the blank is facing upwards.

The known aforementioned transfer rollers are complicated, trouble-prone and relatively slow-working means for extracting the blanks. A relatively large amount of time is needed for the extraction process because of the combined roll and transverse motion. With packing machines of very high performance, this leads to bottle-necks in this area of production.

SUMMARY OF THE INVENTION

The invention is based on the object to propose which guarantee a safe and very quick extraction of blanks from a blank magazine.

In order to attain this object, the process for extracting the blanks from the blank magazine is characterized in that the (lowermost) blank which is to be extracted is grasped at a marginal portion, extracted from the blank magazine and is then led and herewith deformed with the grasped portion into a conveying track which is oriented in an acute angle relative to the plane of the extraction opening and in that finally the blank is completely extracted from the blank magazine and transported away by conveying means.

With the process according to the invention, a marginal or end portion of the blank is grasped (first). With elongated, rectangular blanks, such as the ones used for the production of (cigarette) hinge-lid boxes, the blank is grasped at an end portion facing a narrow side and moved downwards out of the extraction opening of the blank magazine with said portion. The portion being opposite the extracted portion still lies within the magazine to start with, so that the blank is deformed to a slightly curved shape oriented in an acute angle. Herewith, the extracted portion of the blank is moved into the plane of a conveyor track and then grasped by conveying means. These extract the blank completely out of the cigarette magazine.

One outstanding feature of the invention is therefore, that only a portion of the blank performs a very sparse movement, specifically a pivoting movement within a small, acute angle, for the blank to get from the plane of the extraction opening into the plane of the conveyor track.

The apparatus according to the invention is provided with an extraction means, which grasps the lowermost blank at a marginal or end portion and downwardly moves it out of the blank magazine. Preferably, the extraction means is a blank segment driven swingingly, which has a slightly arched contact surface for a blank or a portion thereof. The blank segment is swingingly actuated into a roll motion, with the first grasped end portion of the blank being moved downwards out of the blank magazine, while the remaining portion of the blank comes to rest against the contact surface as well because of the characteristic of the movement.

Herewith, an end portion of the blank segment or contact surface holding the blank, reaches the plane of a conveyor track, where free parts of the blank can be grasped by conveying means, especially conveying rollers.

The blank segment is supported by a rocking arm, being moved along an angle rocking to and fro, which is arranged about central below the blank magazine and thus causes the described roll motion of the blank segment with the contact surface on the bottom side of the blank which is to be extracted.

Further features of the invention relate to the design of the blank segment, the blank magazine and to the means for conveying the extracted blanks away.

An exemplary embodiment of the invention is described in detail below with reference to the drawings which show:

DETAILED DESCRIPTION OF A PREFERRED EMBODIMENT

Figure 1:
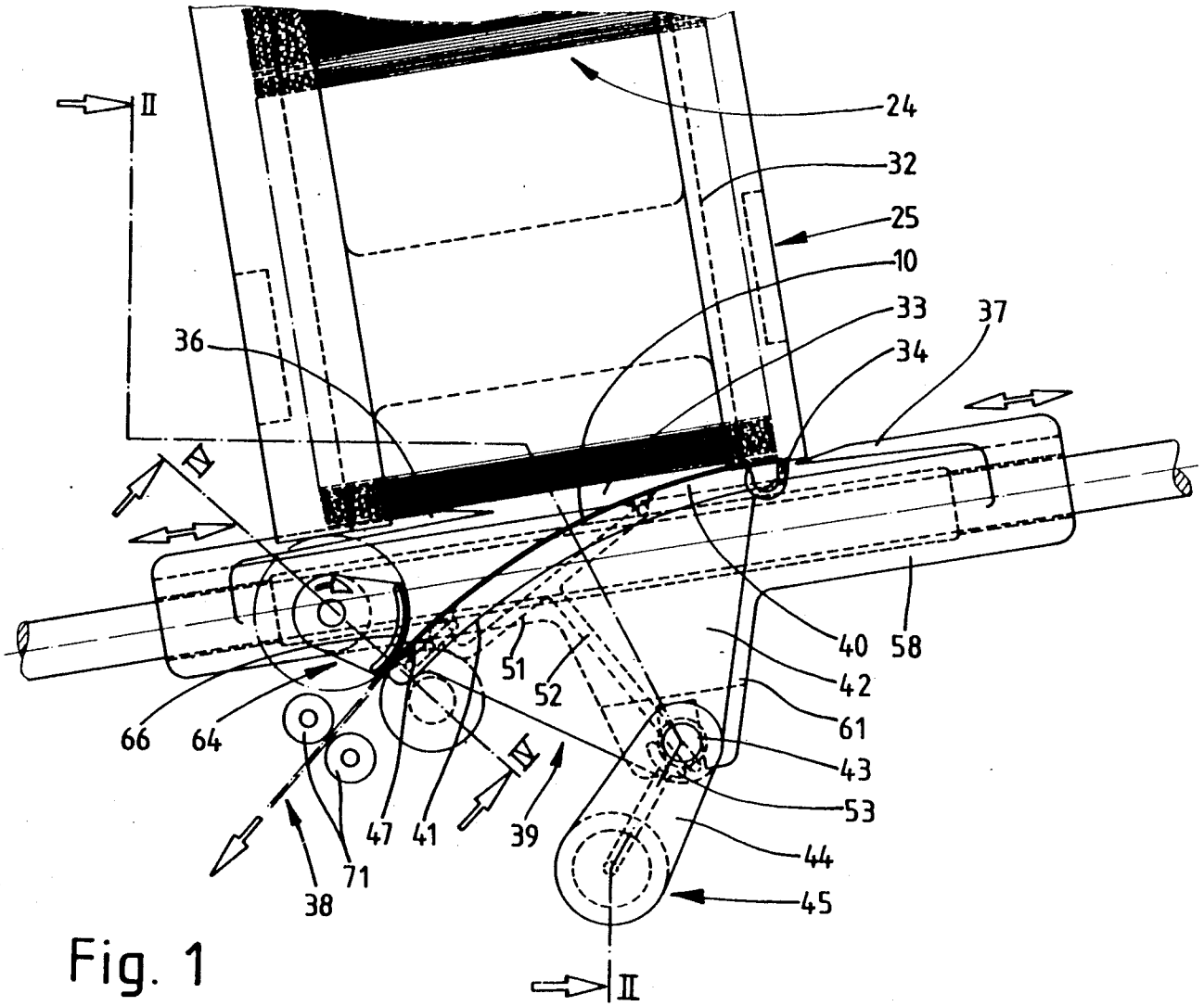
FIG. 1 a side view of a lower part of a blank magazine with apparatus for extracting the blanks, FIG. 2 a transverse view or section of the apparatus according to FIG. 1 taken along the sectional plane II—II on an enlarged scale, FIG. 3 a side view according to FIG. 1 showing details of the apparatus with means in different position.
Figure 2:
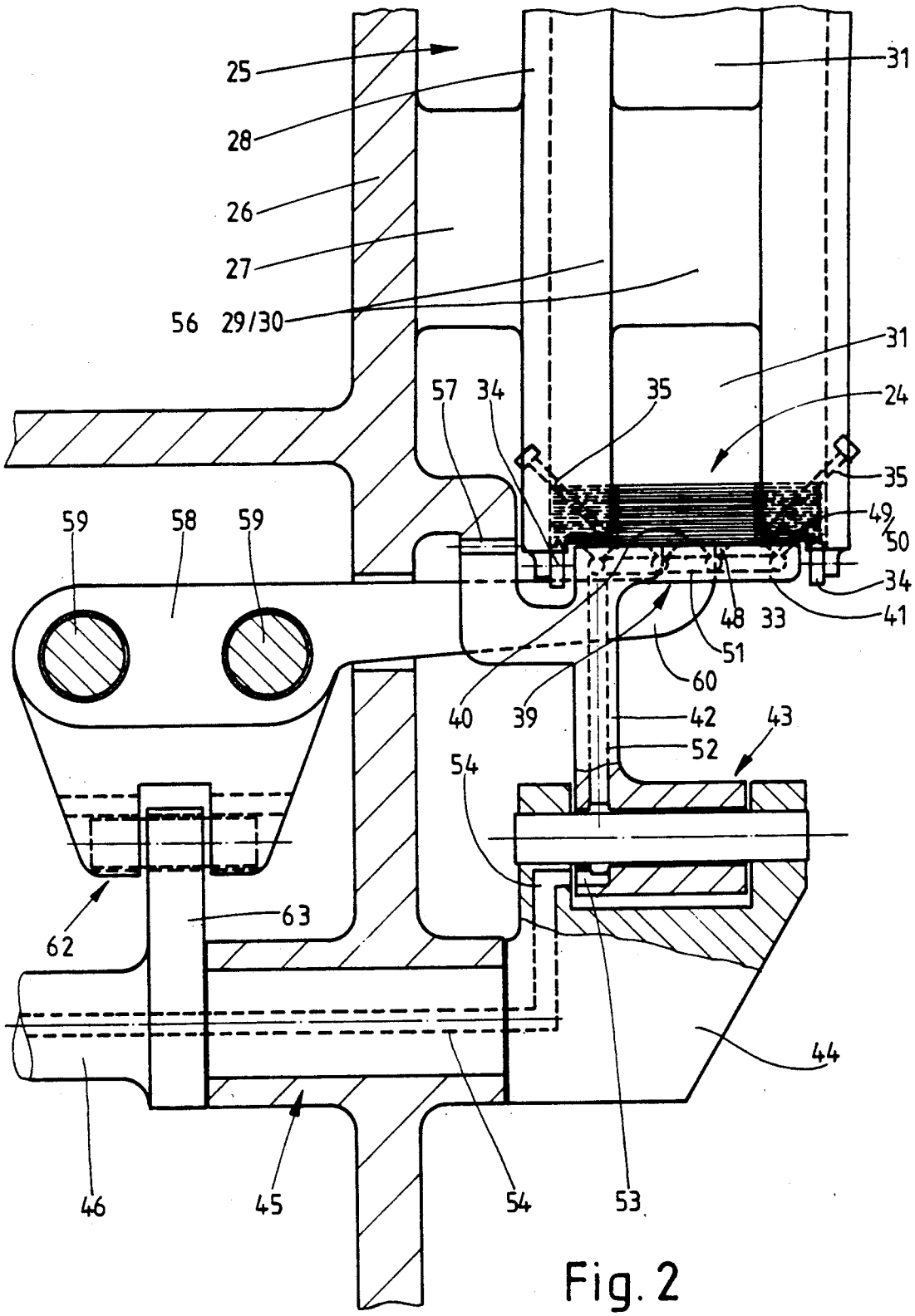

The apparatus shown in the drawings is particularly suitable for handling blanks 10 for making hinge-lid boxes. These boxes are preferably used for holding cigarettes. Hence, the shown apparatus is primarily part of a packing machine for cigarettes.

The blank 10 is made of thin, deformable cardboard and is produced outside the area of the packing machine, its design being well known. Folding lines mark portions for forming the front wall 11, bottom wall 12, rear wall 13, lid s rear wall 14, lid upper wall 15 and lid front wall 16. Side tabs 17 and 18 for forming the side walls of the pack adjoin to front wall 11 and rear wall 13. In analogy, lid rear wall 14 and lid front wall 11 are provided with lid side tabs 19 and 20 on their sides. Extending from the side tabs 17 and 18, namely inbetween the two, are bottom corner tabs 21, which by means of punches are free on three sides and are only joined to the (inner) side tab 18. Correspondingly, lid corner tabs 22 are joined to lid side tabs 19, but apart from that free.

An inner lid tab 23 is located on the free side of the lid front wall 16, said inner lid tab 23 being folded down against the inner side of the lid front wall 16 when the pack is completed.

Blanks 10 with this design or a similar one are supplied to the packing machine in blank stacks 24. A blank supply formed out of such blank stacks 24 is received by a blank magazine 25, which is arranged in the packing machine in an appropriate relative position to a folding aggregate, especially a folding turret. With the present embodiment, the blank magazine 25 is arranged with inclination relative to the vertical line.

The blank magazine 25 is arranged on a wall 26 of a machine frame and connected thereto via a crosspiece 27. The blanks 10, that is to say the blank stack 24 is held in the blank magazine 25 on three sides. A continuous, preferably closed side wall is located on the side facing the wall 26. Joined hereto are end walls 29 and 30, which on the corners of the blank magazine 25 are designed as continuous, upright profiles, but which have orifices 31 in their center region. The end walls 29, 30 are adapted to the contour of the blank 10. In the region of end wall 30, free edges of the front wall 11 rest against a projection 32, thus being supported. The side of the blank magazine 25 lying opposite the side wall 28 is open apart from corner profiles of the end walls 29, 30.

The bottom side of the blank magazine 25 is provided with an extraction opening 33 extending nearly over the whole cross-section of said blank magazine 25. In order to hold the blank stack 24 in the blank magazine 25, the blanks are supported in the extraction opening 33 only at specific marginal or end portions. The end wall 30 facing the front wall 11 has lateral supporting means in the form of supporting rollers 34 in regions extending in longitudinal direction of the blanks 10. The respective lowermost blank 10 of the blank stack 24 rests with outer marginal portions of side tabs 17 on these rotatable supporting rollers 34.

On the opposite side, in the region of the blank parts for a hinged lid, inclined needles 35 are arranged on two oppositely situated sides of the blank 10, specifically in the region of the inner lid tab 23. Only the very ends of said needles 35 project from the contour of the end wall 29. The main function of the needles 35 is to prevent that several blanks 10 are extracted from the blank magazine 25 simultaneously.

Further supporting means, namely supporting fingers 36 and 37, contact the bottom side of the blanks 10 in a center region. Said supporting fingers 36, 37 are the most important supporting means for the blank stack 24. The supporting fingers 36, 37 are moveably arranged, namely in longitudinal direction of the blanks 10. The movement of the supporting fingers 36, 37 is tailored to the extraction of the blanks, such that in the region of the blank extraction, the respective supporting finger 36, 37 is moved out a of supporting position. The free ends of the supporting fingers 36, 37 are sharpened in order to keep them from getting caught on blanks 10.

The blanks 10 are extracted from the blank magazine 25 successively, i.e. one by one, and introduced into a conveyor track 38. In this track, the blanks reach a processing station, especially a folding turret. Said conveyor track 38 starts underneath the blank magazine 25 and in this embodiment is oriented downwardly in an inclined plane with an angle of approximately 45° to the horizontal line.

Figure 7:
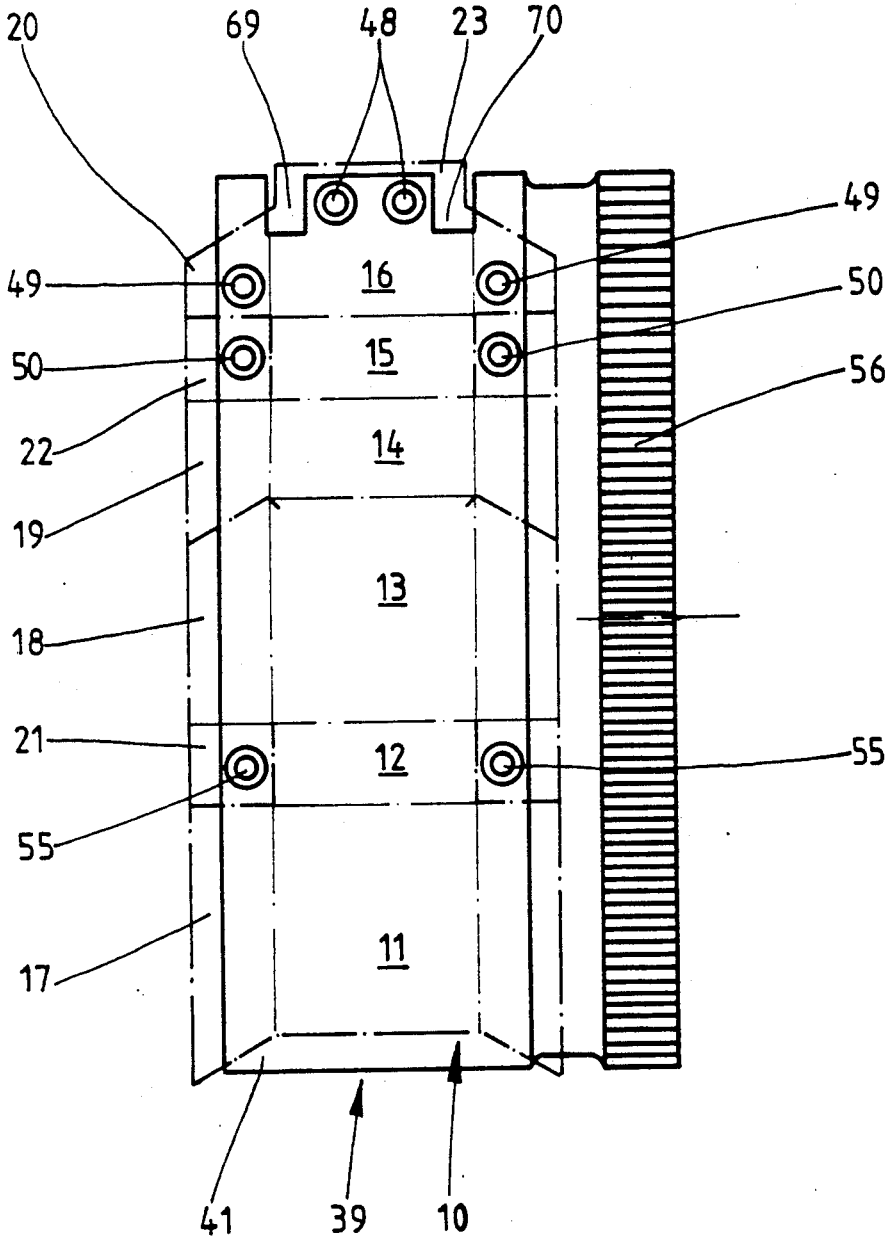

The extraction of blanks 10 from the blank magazine 25 is performed by a moveable extraction means in the form of a blank segment 39. On the outer or upper side of a holding plate 41, a slightly curved, arched contact surface is formed, having a width slightly smaller than the free width of the extraction opening 33. While being transported by the blank segment 39, the blanks 10 contact the holding plate 41 nearly with their complete surface (FIG. 7).

The holding plate 41 is supported via a crosspiece wall 42 in a pivot bearing 43. Said crosspiece wall 42 is connected off-center, namely laterally, to the holding plate 41.

The pivot bearing 43 connects the blank segment 39 or cross-piece wall 42 with a rocking arm 44. Said rocking arm 44 is held by a central pivot bearing 45.

Figure 3:
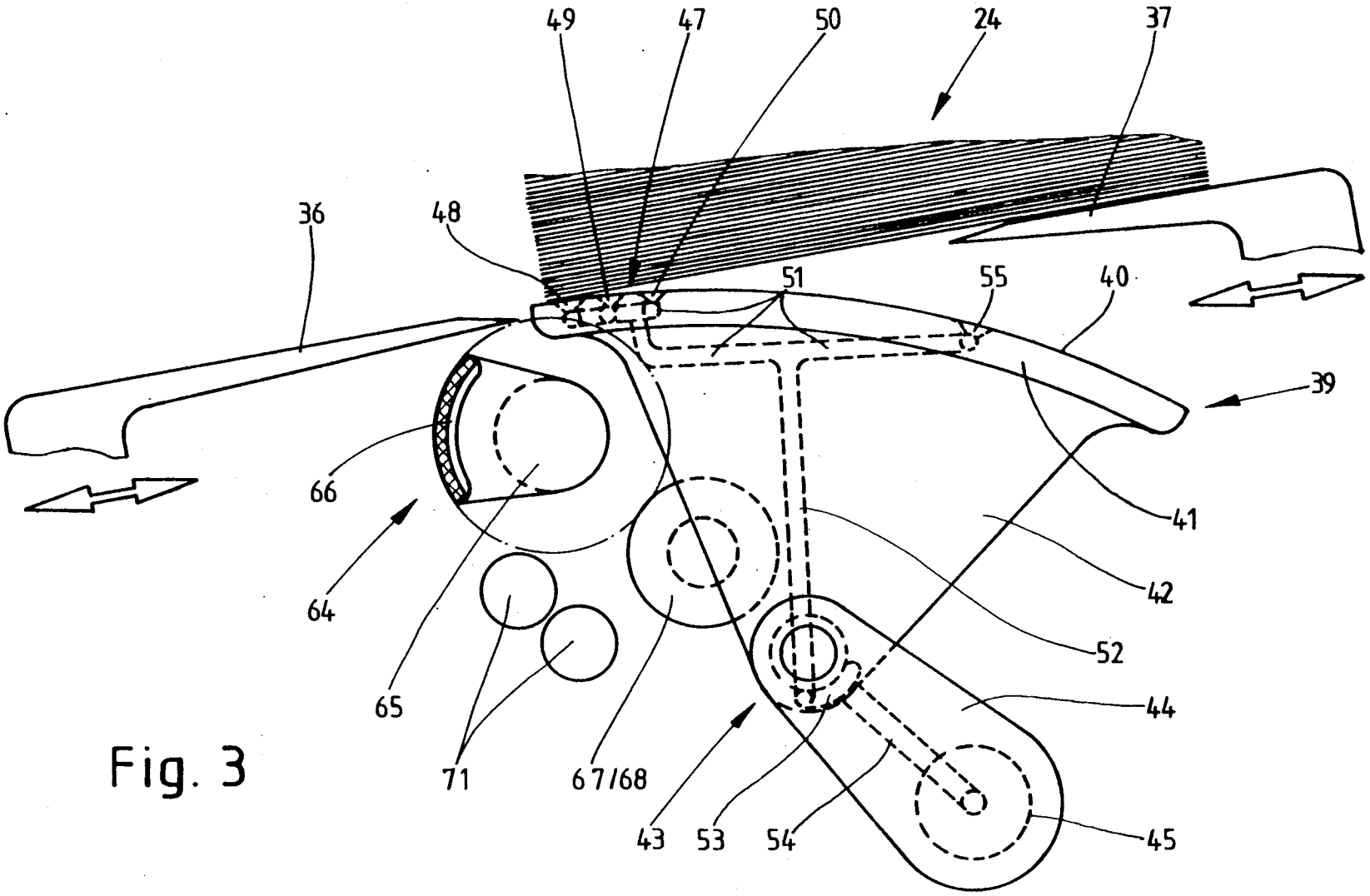
Figure 4:
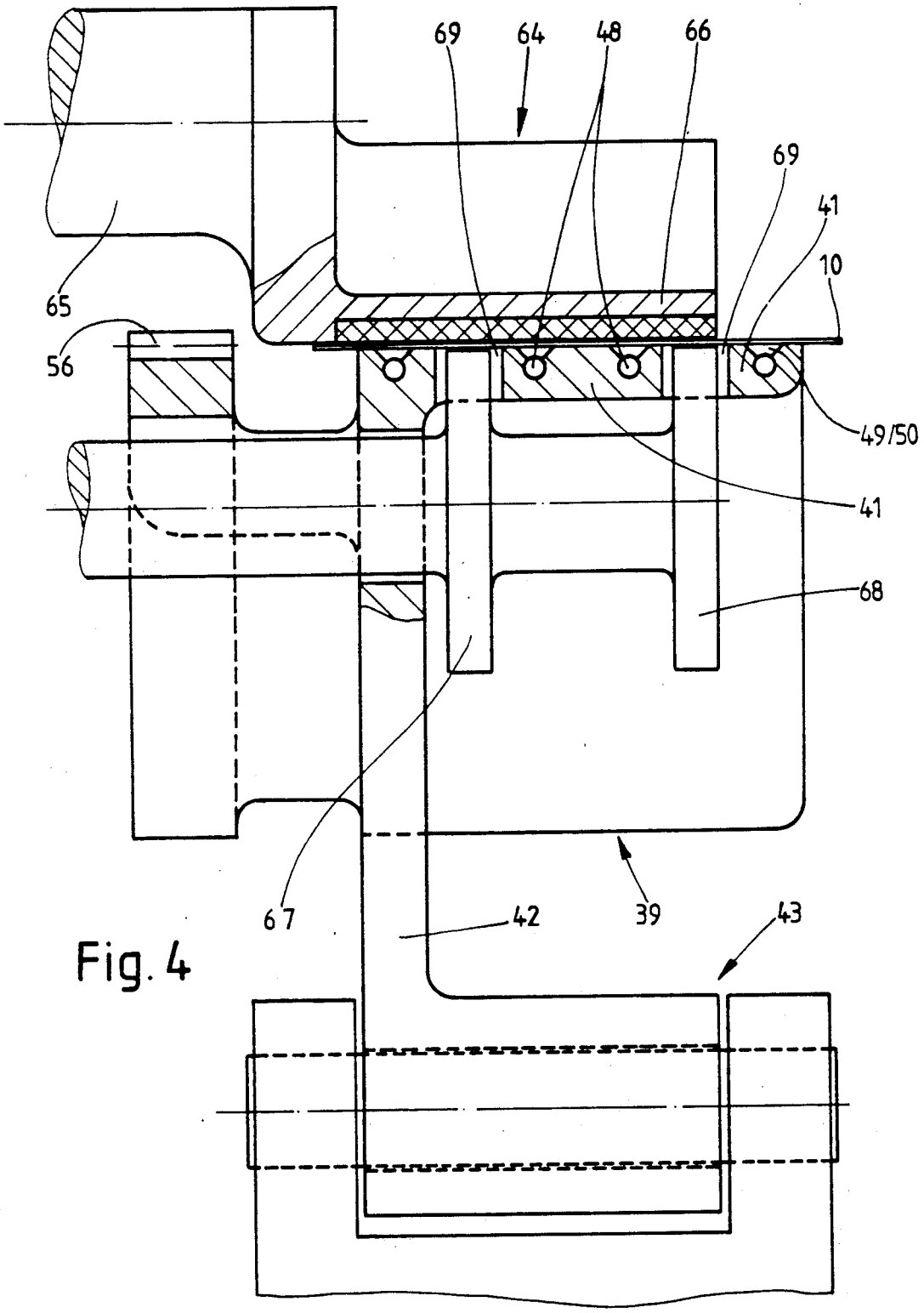
FIG. 4 a section of details of FIG. 1 taken along the sectional plane IV—IV, FIG. 5 a side view of means for driving a blank segment shown in different positions, FIG. 6 a ground plan of the blank magazine, FIG. 7 a ground plan of the blank segment.
Figure 5:
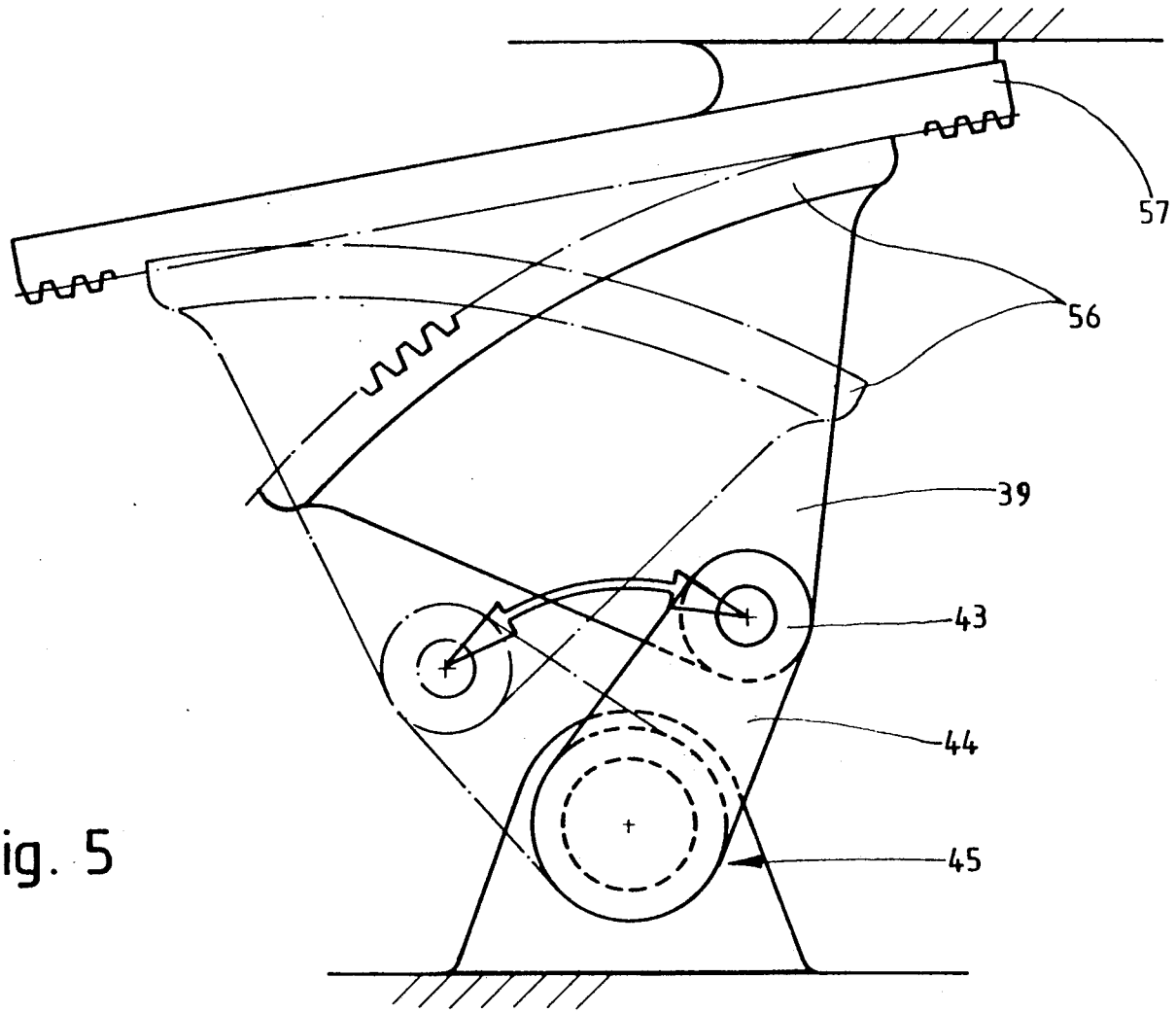
Figure 6:
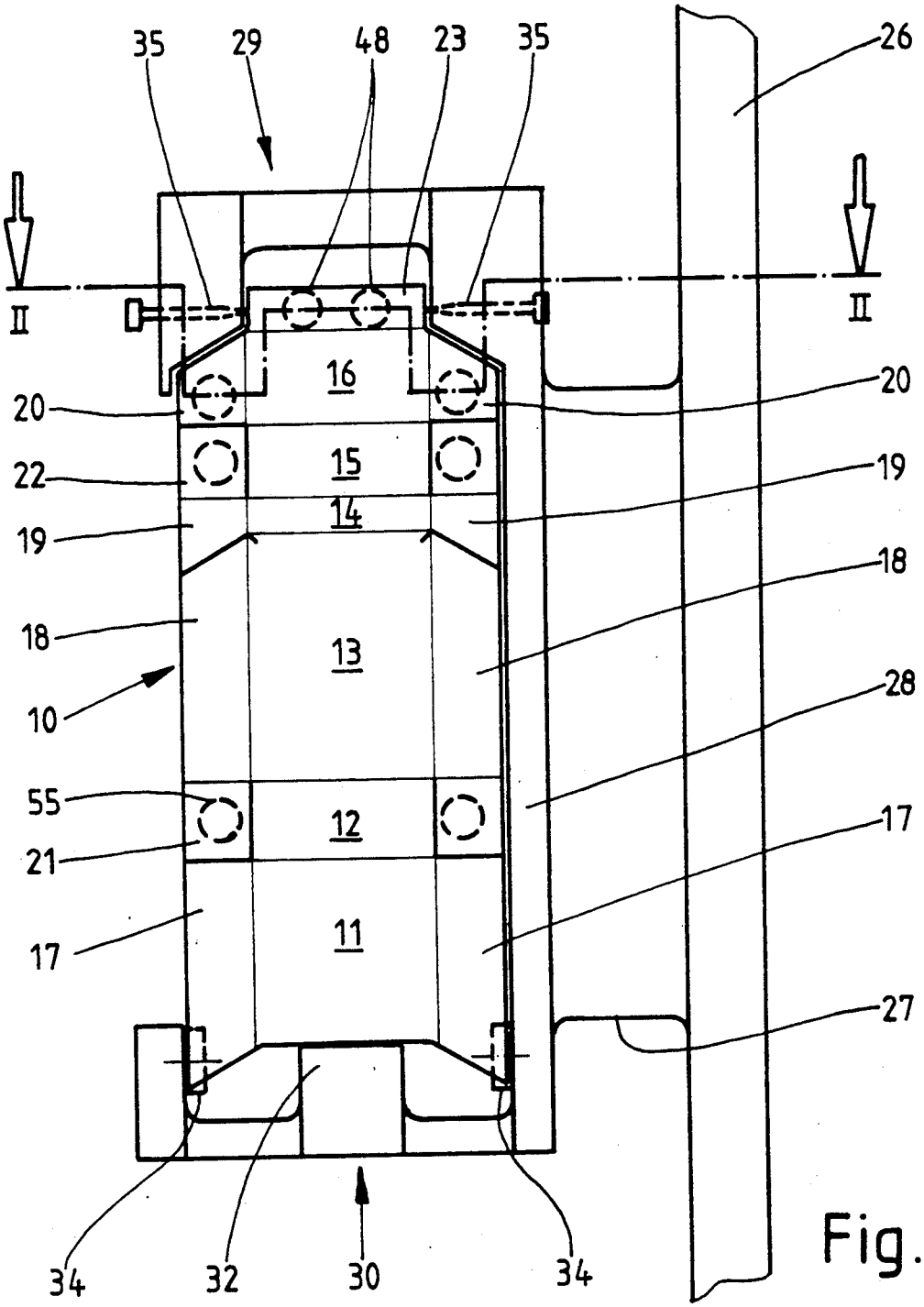

The rocking arm 44 is driven by a driving shaft 46 so that it swings backwards and forwards, one end position being shown in FIG. 1 and the other end position in FIG. 3. The movements of said rocking arm 44 are transmitted to the blank segment 39, which performs, due to the preset kinematics with the holding plate 41 or contact surface 40, a roll motion on the bottom side of the blank stack 24. In starting position (FIG. 3), the contact surface 40 or holding plate 41 rests with a marginal holding section 47 on an end portion of the elongated blank 10, which in the present embodiment is basically formed by lid front wall 16 and inner lid tab 23. Due to the pivoting and transverse motion of the crosspiece wall 42, the arched contact surface 40 is then moved across the bottom side of the lower blank 10 in a roll motion into the position according to FIG. 1. Lower blank 10 herewith comes to rest against the contact surface 40 and is deformed curve-like.

The respective (lowermost) blank received by the blank segment 39 is held on the contact surface 40, in the present embodiment by means of suction air. Several suction bores 48, 49 and 50 are distributed over the holding section 47 of the holding plate 41 which grasps blank 10 first. Said suction bores open out to the contact surface 40 and are linked to an arched segment channel 53 via connection channels 51 and a radial collecting pipe 52. Said segment channel is linked to a suction pipe 54 which leads to a vacuum source. Said suction pipe 54 first extends in longitudinal direction of the rocking arm 44 and then bends again and is led symmetrically through the driving shaft 46. Underpressure reaches suction bores 48, 49 and 50 via this conduit system and sufficiently holds the blank 10 on the contact surface 40.

Suction bores 48 . . . 50 are distributed in a special way in order to optimally fix the blank 10 in position on the holding plate 41. Two suction bores 48 are located side-by-side in the region of the projecting inner lid tab 23. One suction bore 49 each is assigned to lid side tabs 20. Likewise, each lid corner tab 22 is provided with a suction bore 50. This way the critical, that is to say unstable, projecting portions of the blank 10 are covered by suction bores.

One further suction bore 55 is disposed in the region of each bottom corner tab 21.

When performing the swinging motion, the blank segment 39 is guided by means of being supported with a toothed segment 56 connected to the blank segment 39 on a stationary toothed rack 57 which is connected to the machine frame. Because of the specific characteristic of movement of the blank segment 39, said toothed rack 57 is inclined relative to the horizontal line in an acute angle of approximately 10°. The toothed segment 56 is connected to the crosspiece wall 42 and extends next to the blank magazine 25. The roll plane of the toothed segment 56 and the toothed rack 57 is located on the plane of the contact surface 40.

In and out of supporting position, the supporting fingers 36, 37 are moved in synchronism with the blank segment 39 in the extraction opening 33. For this reason, the supporting fingers 36, 37 can be shifted in one plane parallel to the blanks 10. The motion is such, that supporting finger 36, which is facing the holding section 47 of the blank segment 39, is drawn back from the region of the extraction opening 33, when the holding section 47 contacts the assigned portion of the lower blank 10 (position in FIG. 3). The opposite supporting finger 37 is in supporting position, extending far into the extraction opening 33.

By moving blank segment 39 into the position according to FIG. 1, the supporting fingers 36, 37 are jointly shifted as well, until supporting finger 37 has left the region of the extraction opening 33 completely and opposite supporting finger 36 extends into said opening. Supporting finger 36 therewith contacts the bottom side of the following blank 10 of the blank stack 24.

In order to perform this movement, the supporting fingers 36, 37 are connected to one another via a common cradle 58, which is shiftably mounted on two spaced out supporting bars 59. Said supporting bars are firmly joined to the machine frame in a position oriented in an acute angle. Said cradle 58 with supporting bars 59 is arranged offset to the blank magazine 25, thus being distinctly apart from said magazine 25. Supporting fingers 36, 37 are linked to the cradle 58 via transverse oriented cantilevers 60. In order to produce the coordinated driving, the cradle 58 is coupled to the drive for the blank segment 39 via a downwardly directed extension 61, to be specific via a pivot bearing 62 with a driving arm 63 on the drive shaft 46. The axis of this pivot bearing 62 is oriented the same way as the axis of the pivot bearing 43 for the blank segment.

When the extraction process for a blank 10 from the blank magazine 25 begins, a marginal or end portion—in the shown embodiment the portion with innner lid tabs 23 and lid front wall 16—is grasped by the blank segment 39 (FIG. 3) and by means of pivot and roll motions of the holding plate 41 is brought into a curved position (FIG. 1). The portion in curved position is that portion of blank 10, which is grasped first, i.e. inner lid tab 23, lid front wall 16 and adjoining portions of the blank 10 in the plane of the conveyor track 38. The blank 10 is now grasped by a conveying means, pulled out of the blank magazine 25 completely and transported away. For this reason, the suction air in the region of the suction bores 48, 49 . . . is cut off.

Assigned to the conveyor track 38 are conveying means which grasp the blank 10 in the region of portions projecting from the contact surface 40. In the present embodiment, the blanks 10 are transported by conveying rollers or drums.

A driving roller in the form of segment roller 64 grasps the blank 10 which is lying on the contact surface 40 at its free upper side in a region situated forwardly relative to the conveying direction (inner lid tab 23..). Said segment roller 64 is driven for rotation by a shaft 65. A drive segment 66 grasps the blank 10 and pulls it off the contact surface 40 in the direction of the conveyor track 38. The driving segment 66, being part of the segment roller 64, is provided with a surface which has an increased frictional drag and is made for example of rubber, synthetic material or the like.

The above described driving means for the blank are designed such that said swinging roll motion of the blank segment 39 or holding plate 41 can be performed without any malfunctions. For this reason, especially the conveying roller which is taking effect on the free (upper) side of the blank 10 on the contact surface 40, has to leave the path of motion of the holding plate 41 temporarily. This is made possible by the conveying roller being in the special form of a segment roller 64 with a driving segment 66 which is arranged offset to the central shaft 65. As can be seen for example in FIG. 3, the driving segment 66 is located outside the path of motion of the holding plate 61 in this position.

The segment roller 64 works together with counter rollers 67, 68, which are taking effect on the blank 10 on that side of said blank 10, which is oppositely situated to the segment roller 64. In the present embodiment, counter rollers 67, 68 pass through recesses 69, 70 in the holding plate 41. Said recesses 69, 70 are arranged on the side of the holding plate being forward with respect to the conveying direction, specifically in the region of inner lid tab 23. Counter rollers 67, 68 can be driven in synchronism with the segment roller 64 or Just follow idle.

The blank 10, which is grasped between the segment roller 64 on the one hand and counter rollers 67, 68 on the other is pulled out of the blank magazine 25 very swiftly by being pulled off the supporting rollers 34 of said blank magazine 25. The further transport is then taken over by a pair of drawing rollers 71 and by further conveying means which are not shown.

The described apparatus for extracting blanks 10 from a blank magazine 25 only necessitates movements or deformations of blanks 10 in a very small-angled region, namely from the plane of the extraction opening 33 into the conveyor track 38, which is oriented to the plane of the extraction opening (33) in a very small acute angle.

What is claimed is:

1. In an apparatus for receiving a stack of blanks made of thin cardboard and for extracting individual blanks from the blank stack, the blank stack being held in a blank magazine having an extraction opening for the individual blanks, the blanks being extracted from the blank magazine by an extraction means movable to and fro, the improvement:

wherein said extraction means (39) comprises a holding plate (41) having a contact surface (40) on which the entire surface of each extracted blank (10) rests;

wherein said holding plate (41) has, in a side facing a discharge outlet for the extracted blank (10), recesses (69, 70); and wherein said apparatus comprises counter roller means (67, 68) for entering said recesses (69, 70) and engaging the blank (10) to discharge the blank.

2. In an apparatus for receiving a stack of blanks made of thin cardboard and for extracting individual blanks from the blank stack, the blank stack being held in a blank magazine having an extraction opening through which the individual blanks are extracted, said apparatus having supporting means for holding the blank stack and being located in a region of the extraction opening at oppositely situated sides thereof, the improvement wherein said apparatus comprises:

pivotable extraction means (39), located adjacent the extraction opening (33) of the blank magazine (25) and being driven to pivot to and fro, for grasping and extracting an individual blank;

said extraction means having a curved contact surface (40), facing towards the extraction opening (33), for contacting one blank (10) at a time;

said extraction means comprising a blank segment (39) for grasping an end portion of the blank (10) to be extracted and moving the blank out of the blank magazine (25) and into a plane of a conveying track (38), so that the blank (10) contacts the curved contact surface (40) and is deformed thereby in an arch-like manner.

3. The apparatus according to claim 2, further comprising conveying means; wherein the portion of the blank (10) which is moved into the plane of said conveyor track (38) by said blank segment (39) is further transportable in a conveying direction by said conveying means which grasp said blank (10) at blank portions projecting from said contact surface (40) of said blank segment (39); and wherein said conveying means comprise recesses (69, 70) in a holding plate (41) of said blank segment (39) having said contact surface (40).

4. The apparatus according to claim 3 further comprising a rocking arm (44), wherein said blank segment (39) is moveable by means of said rocking arm (44), driven to swing in to and fro motions, which is mounted in the region of a pivot bearing (45) and which is driven to swing by a driving shaft (46), said rocking arm (44) being connected to said blank segment (39) by a pivot bearing (43) following the swinging motions.

5. The apparatus according to claim 4, wherein said blank stack (24) in said blank magazine (25) is held by supporting fingers (36, 37) which extend from narrow sides of said blank magazine (25) in a longitudinal direction of the rectangular blanks (10) on the bottom side of said blank stack (24) and which move to and fro in synchronism with said blank segment (39), such that when a blank (10) is grasped at a marginal or end portion thereof by said holding plate (41) of said blank segment (39), the supporting finger (36) assigned to the corresponding side of said blank magazine (25) is drawn back to a position beyond said extraction opening (33).

6. The apparatus according to claim 5, wherein said supporting fingers (36, 37) are mounted to slide on a guide in the form of a cradle (58) slidably mounted on supporting bars (59), and wherein said cradle (58) is driven by said driving shaft (46) for said blank segment (39).

7. The apparatus according to claim 6, wherein said cradle (58) for said supporting fingers (36, 37) is connected with a driving arm (63) of said driving shaft (46) via a pivot bearing (62) which is arranged equiaxially to the pivot bearing (43) of said rocking arm (44) and said blank segment (39).

8. The apparatus according to claim 4, wherein the swinging motions of said blank segment (39) are stabilized by means of a formlocking guide which is in the form of a toothed segment (56) connected to said blank segment (39) and corresponding to the shape of said contact surface (40), and which is in engagement with a stationary toothed rack (57).

9. The apparatus according to claim 3, wherein in a region of said holding plate (41) which is located forwardly with respect to the conveying direction, there are two said recesses (69, 70) for grasping the blank (10) in a forwardly located portion; between driven counter rollers (67, 68) which at least partially enter in said recesses (69, 70).

10. The apparatus according to claim 9, wherein said counter rollers (67, 68) entering in said recesses (69, 70) of said holding plate (41) contact a bottom side of the blank (10) facing said holding plate (41) and a driven roller (segment roller (64) contacts said blank (10) on its free, opposite upper side in order to transport said blank (10) away.

11. The apparatus according to claim 10, wherein at least second conveying means (66), taking effect on the free upper side of the blank (10), are moved out of the path of motion of said blank segment (39) or said holding plate (41) thereof during the extraction motion, said second conveying means being in the form of a segment roller (64) with a driving segment (66), arranged off-center, which is arranged outside of the path of motion of said holding plate (41) during the extraction motion of said blank segment (39).

12. The apparatus according to claim 2, wherein said extraction means is provided with suction bores (48, 49, 50, 55) for grasping and extracting a blank (10) from said blank magazine (25).

13. The apparatus as claimed in claim 2, wherein the blank segment (39) comprises a holding plate (41) provided with a plurality of distributed suction bores (48, 49, 50, 55) opening out into the contact surface (40);

wherein first ones of said suction bores (48, 49) are located in a region of a holding plate end portion forming a holding section (47) for grasping the blank (10) at the start of the extraction process; and wherein second ones of said suction bores (50, 55) are located along longitudinal sides of said holding plate in a region of lateral folding tabs (21, 22) of the blank (10).

* * * * *